US011517070B2

(12) United States Patent
Anderson

(10) Patent No.: US 11,517,070 B2
(45) **Date of Patent: *Dec. 6, 2022**

(54) FOOTWEAR COVERING SYSTEM

(71) Applicant: Steven Anderson, Kelso, WA (US)

(72) Inventor: Steven Anderson, Kelso, WA (US)

( * ) Notice: Subject to any disclaimer, the term of this patent is extended or adjusted under 35 U.S.C. 154(b) by 225 days.

This patent is subject to a terminal disclaimer.

(21) Appl. No.: 16/899,977

(22) Filed: Jun. 12, 2020

(65) Prior Publication Data

US 2020/0337413 A1 Oct. 29, 2020

Related U.S. Application Data

(63) Continuation of application No. 16/396,418, filed on Apr. 26, 2019, now Pat. No. 10,681,956.

(51) Int. Cl.

| | |
|---|---|
| ***A43B 5/18*** | (2006.01) |
| ***A41D 1/08*** | (2018.01) |
| ***A41D 17/00*** | (2006.01) |
| ***A41D 27/20*** | (2006.01) |

(52) U.S. Cl.
CPC ..... *A43B 5/18* (2013.01); *A41D 1/08* (2013.01); *A41D 17/00* (2013.01); *A41D 27/20* (2013.01); *A41D 2600/108* (2013.01)

(58) Field of Classification Search
CPC ..... A41D 17/00; A41D 17/005; A41D 17/02; A41D 3/06; A43B 5/18
See application file for complete search history.

(56) References Cited

U.S. PATENT DOCUMENTS

| | | | | |
|---|---|---|---|---|
| 2,406,090 | A | 8/1946 | Mas | |
| 2,469,863 | A | 5/1949 | Mckenna | |
| 4,856,207 | A | 8/1989 | Datson | |
| 5,642,573 | A * | 7/1997 | Brown | A43B 3/02 36/132 |
| 5,815,948 | A | 10/1998 | Dzielak | |
| 6,185,752 | B1 | 2/2001 | Hendersen et al. | |
| 6,260,209 | B1 | 7/2001 | Ange | |
| 6,381,756 | B1 | 5/2002 | Smith | |
| 6,457,260 | B1 | 10/2002 | Roelofs | |
| 10,681,956 | B1 * | 6/2020 | Anderson | A43B 3/0031 |
| 2004/0055074 | A1 | 3/2004 | Lin | |
| 2010/0064551 | A1 | 3/2010 | Aldridge | |
| 2016/0044978 | A1 * | 2/2016 | Callaway | A41D 13/0575 2/22 |
| 2017/0150774 | A1 * | 6/2017 | Girard | A43B 5/002 |

OTHER PUBLICATIONS

Screenshot of website https://sneektec.com/collections/sneek-boots/products/usa-sneek-boots titled "American Made Sneek Boots," accessed Apr. 23, 2019.
Screenshot of website http://www.rimrok.com/buy-rimrok/gen-ii-rimrok-stalkers titled "Gen II Rimrok Stalkers," accessed Apr. 26, 2019.

* cited by examiner

*Primary Examiner* — Tajash D Patel
(74) *Attorney, Agent, or Firm* — Klarquist Sparkman, LLP

(57) ABSTRACT

A footwear covering system is provided to permit the movement of a footwear covering from a first position, in which it is retained in a retention structure of a leg covering, to a second position in which the footwear covering at least partially covers an article of footwear.

19 Claims, 12 Drawing Sheets

FOOTWEAR COVERING SYSTEM

CROSS REFERENCE TO RELATED APPLICATION

This application is a continuation of U.S. patent application Ser. No. 16/396,418, filed Apr. 26, 2019. The prior application is incorporated herein by reference in its entirety.

FIELD

This disclosure relates to footwear and related gear that facilitate stealthy approaches in hunting and other activities

BACKGROUND

Various gear, equipment, and apparel have long been developed to assist those hunting game in approaching and seizing upon a target. More specifically, gear has been known to help hunters combat weather, the natural elements, and those factors which make hunters detectable to animals in the wild. However, conventional designs in this field have failed to address certain needs of hunters and the limitations of preexisting hunting gear and therefore, further innovation in the field is needed.

SUMMARY

The foregoing and other objects, features, and advantages of the invention will become more apparent from the following detailed description, which proceeds with reference to the accompanying figures.

DETAILED DESCRIPTION

Figure 1A:
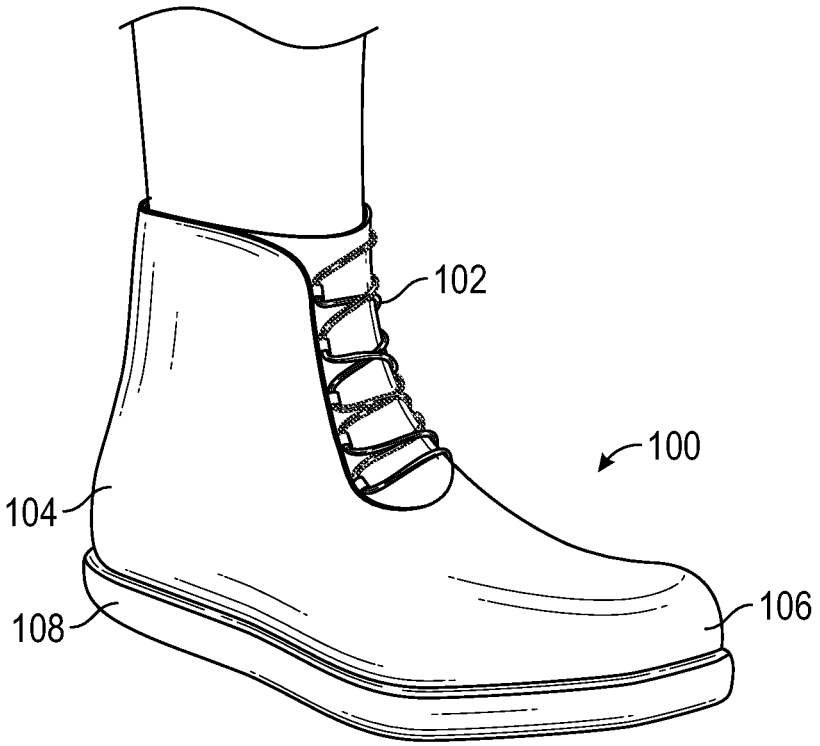
FIGS. 1A-1B are side views of a boot.

Embodiments of the present invention are hereafter described in detail with reference to the accompanying figures. Although the invention has been described and illustrated with a certain degree of particularity, it is understood that the present disclosure has been made only by way of example and that numerous changes in the combination and arrangement of parts can be resorted to by those skilled in the art without departing from the spirit and scope of the invention.

The following description with reference to the accompanying drawings is provided to assist in a comprehensive understanding of exemplary embodiments of the present invention as defined by the claims and their equivalents. It includes various specific details to assist in that understanding but these are to be regarded as merely exemplary.

Accordingly, those of ordinary skill in the art will recognize that various changes and modifications of the embodiments described herein can be made without departing from the scope and spirit of the invention. Also, descriptions of well-known functions and constructions are omitted for clarity and conciseness.

As used in this application and in this application and in the claims, the singular forms "a," "an," and "the" include the plural forms unless the context clearly dictates otherwise. Additionally, the term "includes" and "has" have the same meaning as "comprises." Further, the term "coupled" does not exclude the presences of intermediate elements between the coupled items Tracking and hunting game requires considerable skill and expertise. In particular, bow hunting demands patience, timing, stealth, and proximity to overcome the physical limitations of traditional archery systems and often requires a hunter to traverse miles of various terrain and weather conditions before approaching a target. Although advances in technology have led to powerful recurve and compound bows, bow sights, and quality gear, the need to quietly stalk game and confront the elements remains as important as ever.

When approaching a target, hunters attempt to close the distance between them and the potential target by quietly positioning themselves out of sight and downwind to avoid detection. However, one false move can alert the target of the hunter's presence, causing the target to become alarmed and flee the immediate area.

Currently, hunters often resort to DIY methods to soften their steps to reduce the sound of their approach. Common methods include applying multiple layers of socks to bootless feet, or over the boots themselves; employing separate and awkward strap-on pads; or even wearing traditional moccasins. However, these methods commonly have negative drawbacks.

For example, traditional moccasins and similar footwear generally require the users to wear them for extended periods of time to allow their feet to acclimate to the lack of support, harsh terrain, and weather conditions. And while layering single socks over shoeless feet can be effective, it often requires a hunter to buy multiple pairs of socks after each hunt, and/or leave their boots behind during their approach to a target, which can be anywhere from 100 yards or more away and can possibly make it difficult to relocate them afterward. Finally, using a separate strap-on pad or layering socks either requires walking awkwardly over terrain for an extended period of time and/or takes time away from stalking a target, causing the hunter to break their line of sight of the target for too long and significantly increases the chance of making an unintended sound.

Additionally, an average hunt can result in a hike of anywhere from 2 to 6 miles a day through various conditions, especially when many choose or are required to pack and hike out a successful hunt. It is no surprise then why many choose to also wear gaiters for additional warmth and to protect their legs by creating a seal between the user's pant leg and boot to keep out moisture, debris, and insects. However, a hunter wishing to layer socks or some other covering over their boots must either remove their gaiters entirely or remove and reposition the gaiters, again requiring more time away from an approach. Moreover, because gaiters are meant to protect the lower leg by keeping out dirt, snow, and water from entering the footwear, gaiters become entirely useless if not used in conjunction with the footwear.

Due to the inadequacies and limitations of current outdoor footwear and gaiters, a boot and gaiter combination which allows a hunter to transition quickly and painlessly to and from a fully functioning gaiter to a stealth ready state designed to assist a hunter in their approach is desired.

FIG. 1A shows a conventional hiking/hunting boot 100 having an upper boot portion 102, (e.g., the collar, tongue, and laces); a heel 104; a toe portion 106; and a sole 108.

Figure 1B:
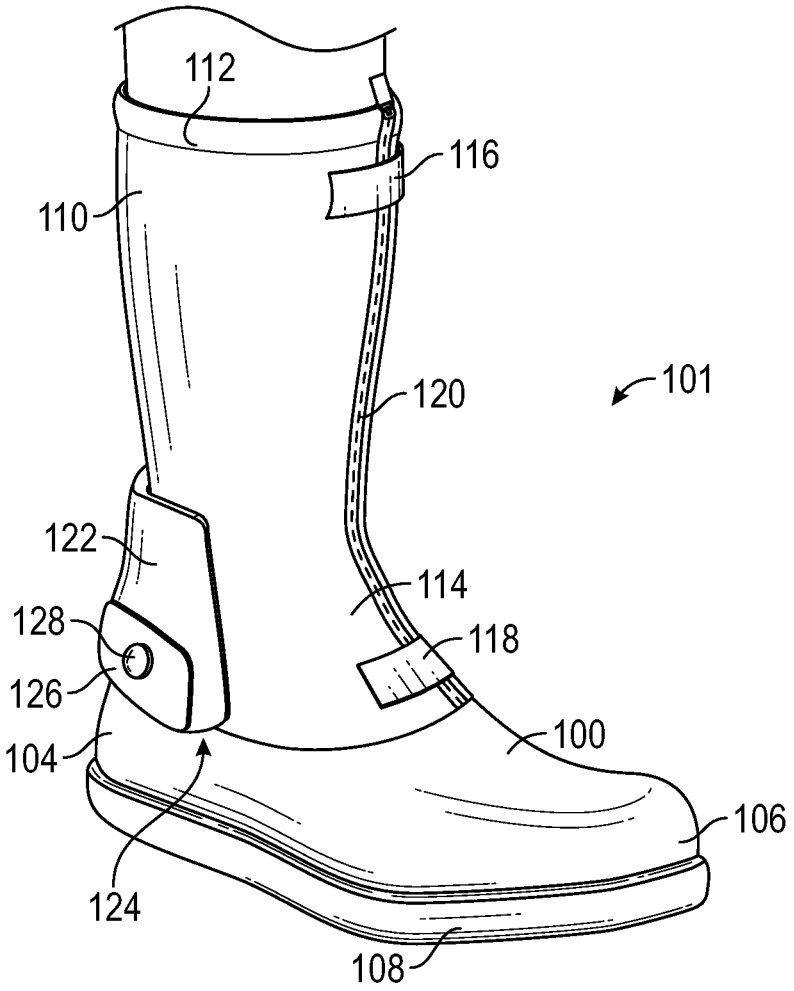

FIG. 1B shows a stalk sock 101 comprising a leg covering 110, which covers the lower leg of the user and the upper boot portion 102. In some embodiments, the leg covering 110 can cover a portion or the entirely of the upper boot portion 102 and/or be constructed from nylon, spandex, polyester, and/or any other suitable material with the desired breathability, durability, and/or resistance. As used herein, the term "stalk sock" refers to a covering that covers a bottom of a foot, either directly or indirectly (e.g., by covering a conventional sock or a sole of an article of footwear).

The leg covering 110 can also include a first end 112, a second end 114, and a seam 120 along its length. In some embodiments, the seam 120 allows the leg covering 110 to open and wrap around the user's leg and can include a zipper, hook and loop, buckle, hooks, buttons, and/or any other appropriate means for closing the seam 120. The leg covering 110 can also have one or more constricting elements 116 and 118, which compress the first end 112 and the second end 114 firmly against the user's leg to keep from sliding or slipping down the user's leg, but which may also be loosened to provide the user customization, comfort, and/or ease of application. In embodiments where the first end and second end 112, 114 form a tight fit to the user's leg, the stalk sock 101 can effectively seal off intrusion (e.g., intrusion of debris, cold air, etc.) into a boot and/or a pant leg of the user.

The leg covering 110 of FIGS. 1A and 1B, can further include a retention structure 124 located proximate to the second end 114 and affixed to or integral with the leg covering 110. The retention structure can include a pocket 122 with a covering 126, where the covering 126 is coupled to or proximate to the second end 114, extends over the opening of the pocket 122, and is capable of being coupled to the surface of the pocket 122 by a coupling element 128. In some embodiments, the covering 126 is coupled to the surface of the pocket 122, extends down to cover the opening, and couples to or proximate to the surface of the second end 114.

Figure 2:
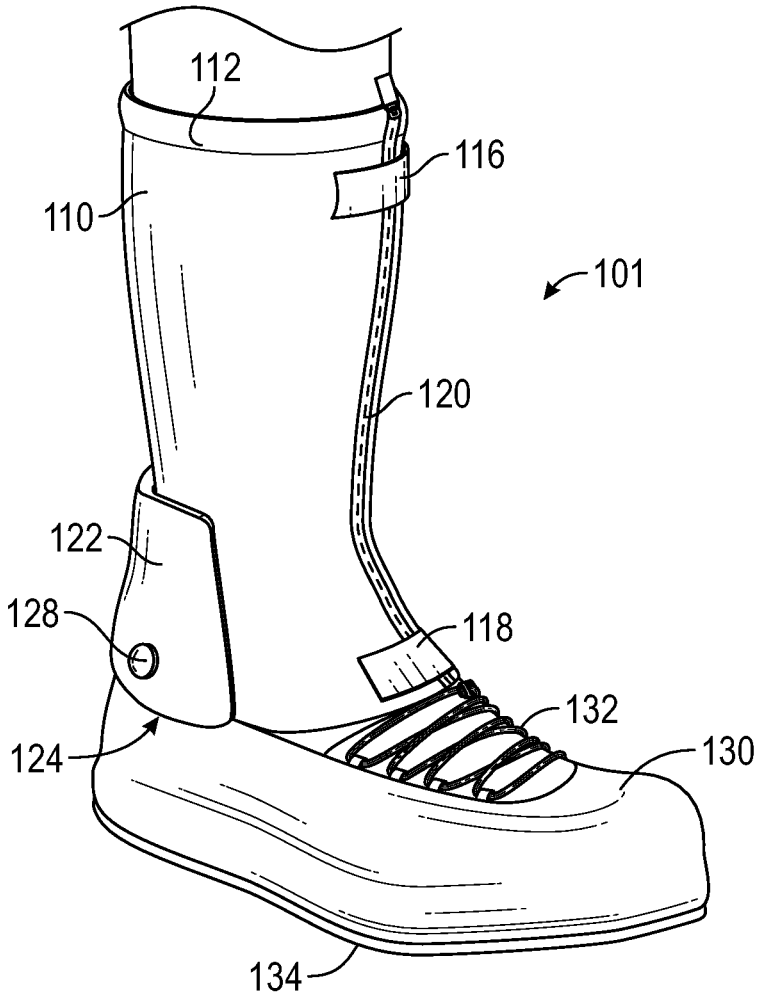
FIG. 2 is a side view of the stalk sock.

In some embodiments, as shown in FIG. 2, the pocket 122 can retain a boot covering 130 attached and/or integral with the leg covering 110, which can extend around the heel 104 and toe portion 106 of the boot 100.

The boot covering 130 can extend out and over the sole of the boot 100, covering the sole completely. Boot covering 130 can held in place on the boot by its shape and size, and preferably some amount of elasticity of a portion that surrounds the opening in boot covering 130.

In some embodiments, the boot covering 130 can have an optional fastening element 132 that surrounds the opening the boot covering to help hold the boot covering in place. For example, fastening element 132 can include an elastic/bungee-like lacing with a chord lock for quickly tightening or loosening the boot covering 130.

In some embodiments, the boot covering 130, including its sole 134, can comprise a durable and soft material such as, but not limited to, wool, fleece, polyester, and/or any other traditional or synthetic fabric to soften the impact and sound of the user's step. The boot covering can be formed of the same material as that of the leg covering, or, in some embodiments a different material.

The boot covering 130 extending from the leg covering 110 in this way allows the user to quickly and effortlessly transition into a "stalking" ready state where the sound of each step is dampened, leaving more likely an approach on a target undetected. For example, the boot covering 130 can remain in the pocket 122 while the hunter is initially searching for a potential target or engaging in other tasks.

Once the hunter identifies a target and wants to begin a stealthy approach, the hunter can open the covering 126 and retrieve the boot covering 130 which can be used to quickly envelope the hunter's boot 100 and ready to dampen the sound of the hunter's step. Ultimately, the sock 101 saves the hunter minutes and significantly reduces the likelihood of making an unwanted sound occurring from reaching and applying socks or separate pads. Additionally, the sock 101 does not require any alteration and/or removal of the gaiter or boots and allows a hunter to effortlessly place the boot covering 130 back in the pocket 122 to avoid walking with the boot covering 130 longer than desired.

In some embodiments, while the boot covering 130 is extended, the covering 126 can rest against and in between the heel 104 of the boot 100 and the boot covering 130. In other embodiments, the covering 126 can be recoupled to a coupling mechanism 128 or left hanging from the pocket 122.

Figure 3:
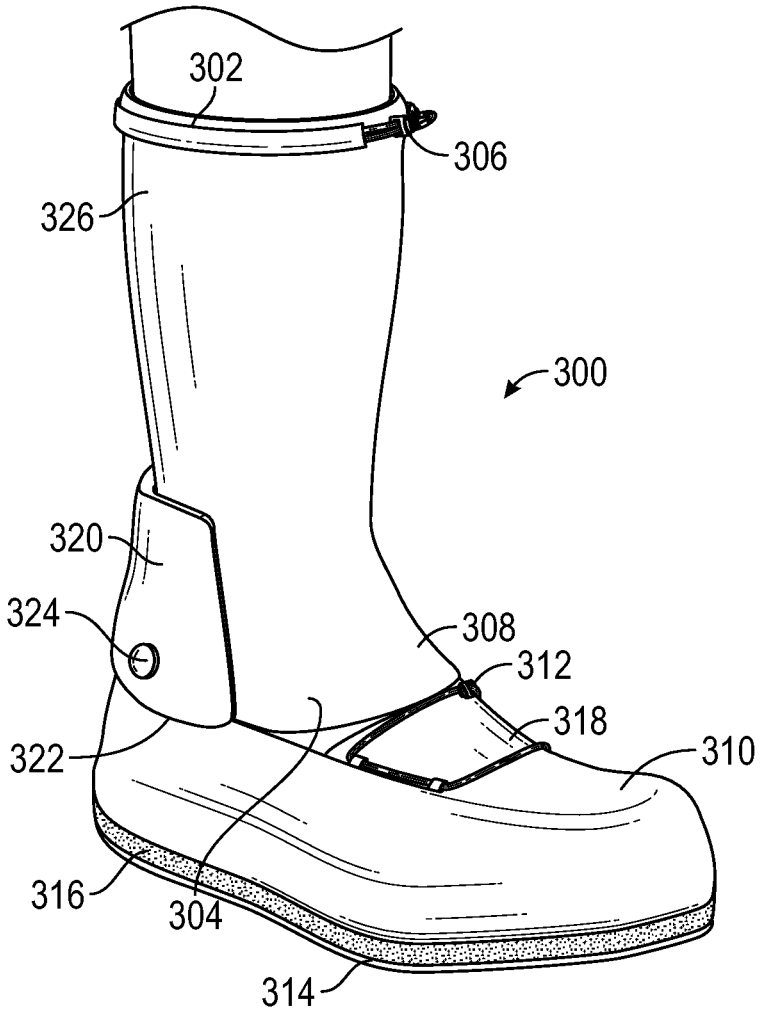
FIG. 3 is a side view of the stalk sock.

The following figures shows how the stalk sock 101 can include a combination and/or variation of different elements to accomplish the above described functionality. For example, as shown in FIG. 3, the stalk sock 300 can include a constricting element 306 having an elastic-bungee drawstring and chord lock, while constricting element 308 can simply be an elastic band within the stalk sock 300 itself. It will be appreciated that the constricting elements 306, 308 can include any single or combination of elements including, buckles, straps, slide belt, elastic, string, lace, etc., or any other appropriate means of compressing the first end 302 and second end 304 of the leg covering 326 against the user's leg and upper portion 102 of the boot 100.

Additionally, the fastening element 312 can be circumferential or square-like lacing that secures the boot covering 310 to the boot 100 and creates an area 318 which can expose or shield a portion of the boot 100. It will be appreciated that the lacing 312 and/or area 318 can act as the primary point at which the user pulls the boot covering 310 taut around the boot 100, where the fastening element 312 can have a chord lock, loose ends, or any other means to tighten and secure the boot covering 310 to the boot 100, such as a strap, slide belt, buttons, and/or hook and loop. The fastening element 312 allows for the boot covering 310 to be secured in a fashion that significantly reduces and/or eliminates slippage of the boot covering 310 off and around the boot 100, and/or allows the stalk sock 300 and leg covering 324 to nearly, if not entirely, envelope and protect the user's boot 100 and lower leg. Further, the leg covering 324 can include a pocket 320 proximate to the second end 304 and having an opening 322, where the boot covering 310 can extend from or proximate to the opening 322.

As shown in FIG. 3, the boot covering 310 can further include a sole 314 that has an additional layer of padding 316 below the material of the boot covering to further reduce the impact and sound of each step. The padding 316 can sit directly below the sole 108 and/or directly or indirectly contact the sole 108, can be sized for a particular boot 100 size and/or shape, and can consist of a single piece or comprise multiple pieces. In other embodiments, the padding 316 can be thicker at the heel and/or ball of the user's foot for a further reduction in sound and can be constructed from various foams and/or materials, including polyurethane, ethylene propylene diene monomer, rubber, neoprene, silicone, urethane, and/or a nitrile rubber and polyvinyl chloride blend.

Additionally, it will be appreciated that the padding 316 can possess different variances including strength, density, pore classification, open cell, closed cell, and/or other forms of water and/or element resistance. These variances allow the stalk sock 300 to be manufactured and suited for various applications. For example, in some embodiments, the padding 316 can be formed from a higher-density and closed cell foam for winter applications, when durability, water resistance, and warmth are desired. In other embodiments, the padding 316 can be a lower density and open cell foam allowing the padding 316 to compress and spring back to its original shape, which may be desirable for drier climates, where dry brush and sticks are ubiquitous and present the increased risk to the hunter of causing unwanted sounds.

Figure 4:
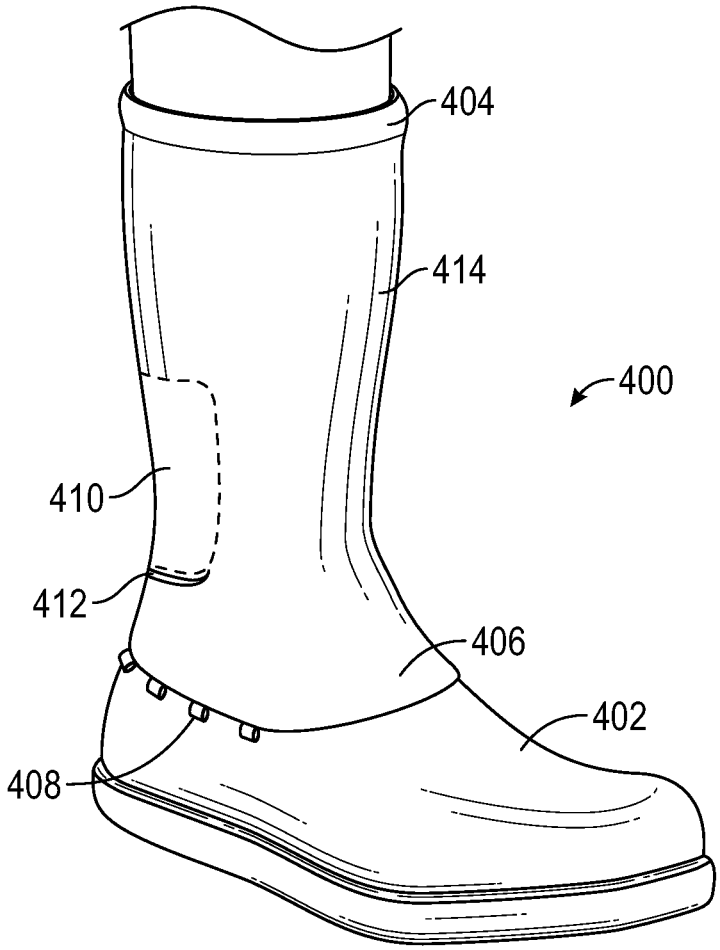
FIG. 4 is a side view of the stalk sock.

As shown in FIG. 4, the stalk sock 400 can have a first end 404 with a cuff-like structure encircling the user's leg, wherein the space spanning the length of the leg covering 414 and between the first end 404 and the second end 406, is shaped to be close-fitting (e.g., much like a tube sock) around the user's leg and boot 100. In some embodiments, the leg covering 414, first end 404, and second end 406 can be made of an elastic material, wool, nylon, and/or any other desirable material. A close-fitting leg covering 414 can have the advantage of simplicity and/or lower production costs due to the decrease in number of elements, but still allow users to benefit from the advantages discussed herein.

Furthermore, the leg covering 400 can have a series of connection points 408 and a detachable boot covering 410. In use, the boot covering can be coupled to the connection points, which may be, for example, a series of loops that mate with a series of hooks on the boot covering as shown in FIG. 4. When not in use, the detachable boot covering 410 can be decoupled from the connection points 408 and received by a retention structure 416 having an aperture 412 included in the surface of the leg covering 414. In some embodiments, the aperture 412 serves as a guide to an internal pocket sewn to or integral with the leg covering 414 where the detachable boot covering 410 can be inserted. In other embodiments, the aperture 412 allows the detachable boot covering 410 to be inserted and retained by a space existing between the user's leg and an internal surface area of the leg covering 414 where the pressure from constricting elements and/or the form of the gaiter portion holds the detachable boot covering 410 in place regardless of a user's movement. In some embodiments, the leg covering 414 allows the detachable boot covering 410 to be retained upward, downward, and/or to either side of the aperture 412.

FIG. 4 further shows that the connection points 408 can be coupled to or integrated with the second end 406 and formed to couple to the detachable boot covering 410. The connection points 408 can include a number of loops designed to receive hooks, buttons, and/or other suitable connectors coupled to or integral with the detachable boot covering 410. For example, each individual connection point 408 can include means to connect with a button, a traditional flat button, buckle, and/or lacing. In other embodiments, the connection points 408 can collectively form a single connection strip 408 along or proximate to the edge of the second end 406. For example, one half of a hook and loop system, or one half of a zipper which would connect to its respective counterpart found on the detachable boot covering 410.

Although aperture 412 is shown at a location above the lowest portion of the leg covering 414, the opening to the pocket can be located at the bottom (e.g., coextensive with the lower opening of the leg covering). In this manner, a separate aperture would not be needed.

The pocket 410 can be smaller than the length of the boot covering. Alternatively, the pocket 410 can be sized to have the same, or greater, length as the boot covering. In this manner, the boot covering can be retained in the pocket without being bunched up or otherwise unnecessarily adding bulk to the leg covering when the boot covering is not in use.

Figure 5:
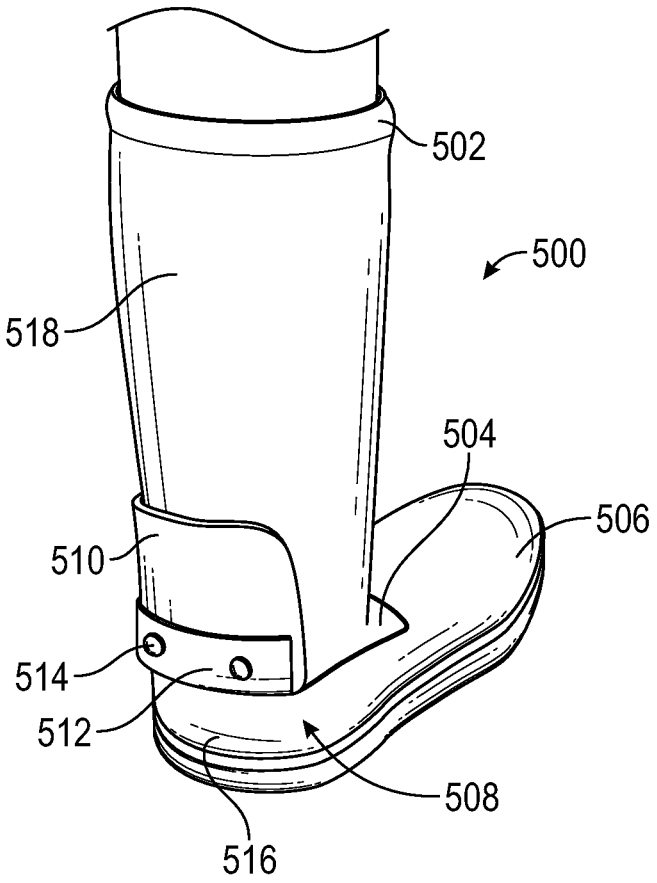
FIG. 5 is a rear perspective view of the stalk sock.

FIG. 5 shows a rear prospective view of the stalk sock 500, similar to that shown in FIGS. 1, 2, and 3. The stalk sock 500 can include the leg covering 518 further including a first end 502, a second end 504, and a pocket 510. FIG. 5 shows the boot covering 512 (similar to those shown in the above embodiments) retained within the pocket 510 with the boot covering 512 fastened to the coupling mechanism 514 and extending into the pocket 510 while attached to the coupling mechanism 514 (e.g., snaps, loops, buttons, etc.). While the boot covering 130, 310 is retained, the heel 516 of boot 506 is exposed and with enough clearance to allow the user to move freely without having to worry about dragging and/or catching the boot covering 130, 310 on the ground. When the user wishes to use the boot covering, it can be simply pulled downward from the pocket 510 and extended to cover the boot while remaining attached to the coupling mechanism. In addition, because it is detachable, it can be easily removed from the leg covering when not in use.

Figure 6:
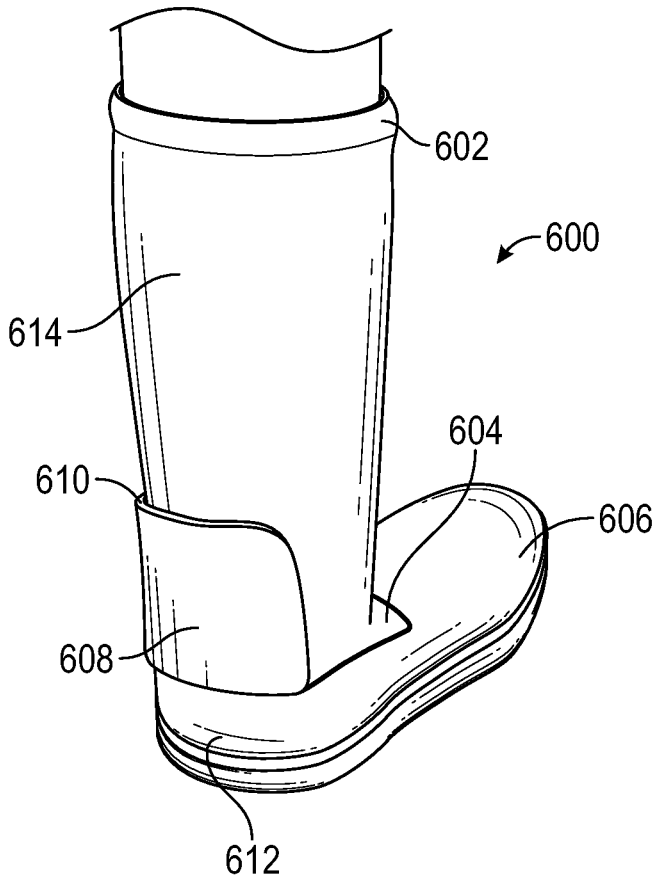
FIG. 6 is a rear perspective view of the stalk sock.

FIG. 6 shows the stalk sock 600 with a retention structure 616 including a pouch 608 located between the first end 602 and the second end 604. As shown in FIG. 6, the pouch 608 can reside on the outer surface of the leg covering 614, either integrated with or coupled to the leg covering 614. In some embodiments, the pouch 608 can include an opening 610 at its upper end (i.e., the top half of the pocket 608 farthest from the second end 604 and closest to the first end 602) to allow the user to insert a detachable boot covering 410 such as the one shown in FIG. 4. Alternatively, in other embodiments, the opening 610 can be proximate to the second end 604 and heel 612 where, for example, the pocket 608 can retain a boot covering upward from the second end 604, including the boot covering 410 shown in FIG. 4, or the boot coverings 130, 310 shown in FIGS. 1-2 and FIG. 3, respectively.

Figure 7:
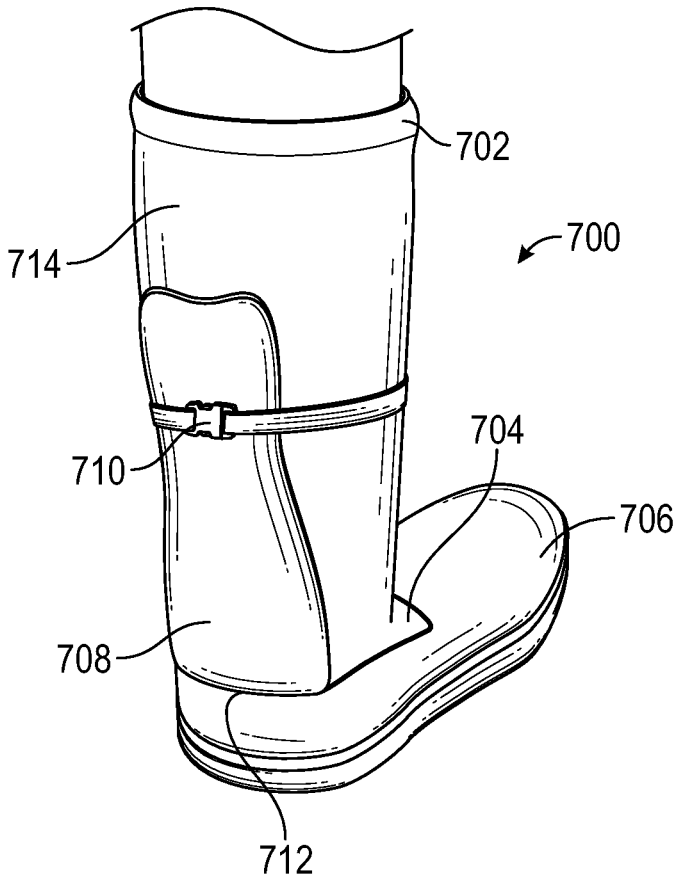
FIG. 7 is a rear perspective view of the stalk sock.

FIG. 7 shows another alternative retention structure 716 where the boot covering 708 is held in place by a strap element 710 located at some distance along the leg covering 714, between the first end 702 and second end 704. The retention of the boot covering 708 in this way allows the boot covering 708 to be pulled upward and held in place against the surface of the leg covering 714, regardless of whether the boot covering 708 is coupled at (e.g., through connection points 408) or integral with the gaiter portion 714 at a fold 712. Although shown as extending along the outside of the leg covering, the strap element could also function to hold the boot covering in place along the inside of the leg covering.

In some embodiments, the strap element 710 can include a buckle system, slide belt, elastic, lacing, rope, bungee, hook and loop, and/or any appropriate means for securing the boot covering 708 against the leg covering 714. In some embodiments, the strap element 710 is the sole element of the retention structure 716 to retain the boot covering 708. This embodiment ensures that the boot covering 708 is readily accessible at a moment's notice.

In other embodiments, the boot covering 708 can temporarily be held against the leg covering 714 when a pocket or pouch (e.g., 510 or 608) is also included. For example, if a hunter has retrieved the boot covering 708 from a pocket (e.g., the pocket 510 shown in FIG. 5), but desires to uncover their boot 100 for some time, but wants to keep it accessible, the hunter can pull the boot covering 708 back and over the pocket 510 to secure it to the leg covering 714 by the strap element 710 without having to fully retain it in the pocket 510.

Figure 8:
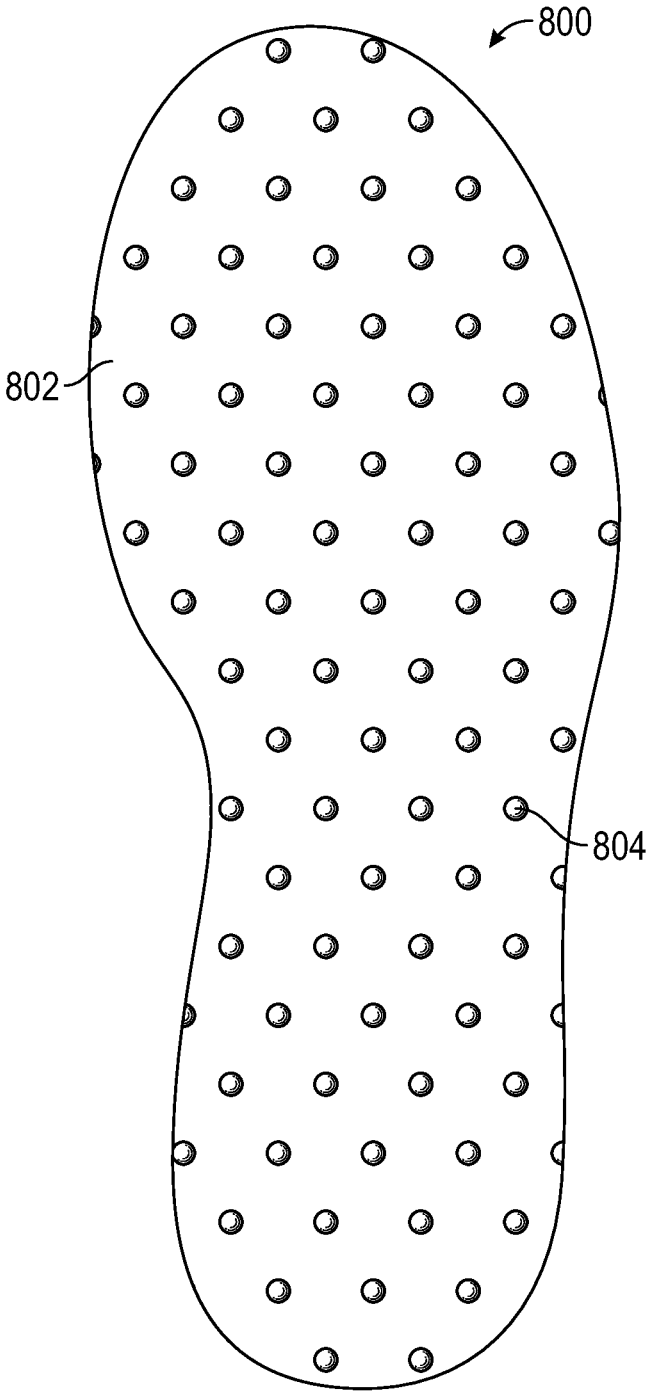
FIG. 8 is a bottom view of the sole of the stalk sock.

FIG. 8 shows the sole 800, similar to the sole 134, 314 discussed above and shown in FIGS. 1-3, in more detail. FIG. 8 shows that the sole 800 can include a fabric 802. The fabric 802 can act as the primary sound dampening element or in conjunction with the padding 316 as discussed above to soften the step of the user as much as possible. The fabric 802 can be constructed of wool, Berber fleece, polyester, nylon, durable foam, and/or other suitable soft material to dampen the sound or lessen the impact of the user's step. In some embodiments, the fabric 802 can be the single contacting surface included in the sole 800.

As shown in FIG. 8, ground contacting elements 804 can also be included in the sole 800 and used in conjunction with fabric 802. For example, the ground contacting elements 804 can be made of rubber or any other suitable material used for outer sole manufacturing and included into the sole 800 to provide the user increased traction for use in varying terrain and conditions. The sole 800 can have any number of ground contacting elements 804 to provide adequate traction but as to avoid negating the effects of the dampening fabric 802 and/or padding 316. In some embodiments, the ground contacting elements 804 can take any shape of form, cover any area of the sole 800, and/or can have any length extending from the surface of the sole 800. In other embodiments, the ground contacting elements 804 can be arranged in any pattern such as lug pattern and/or a heel brake.

Figure 9:
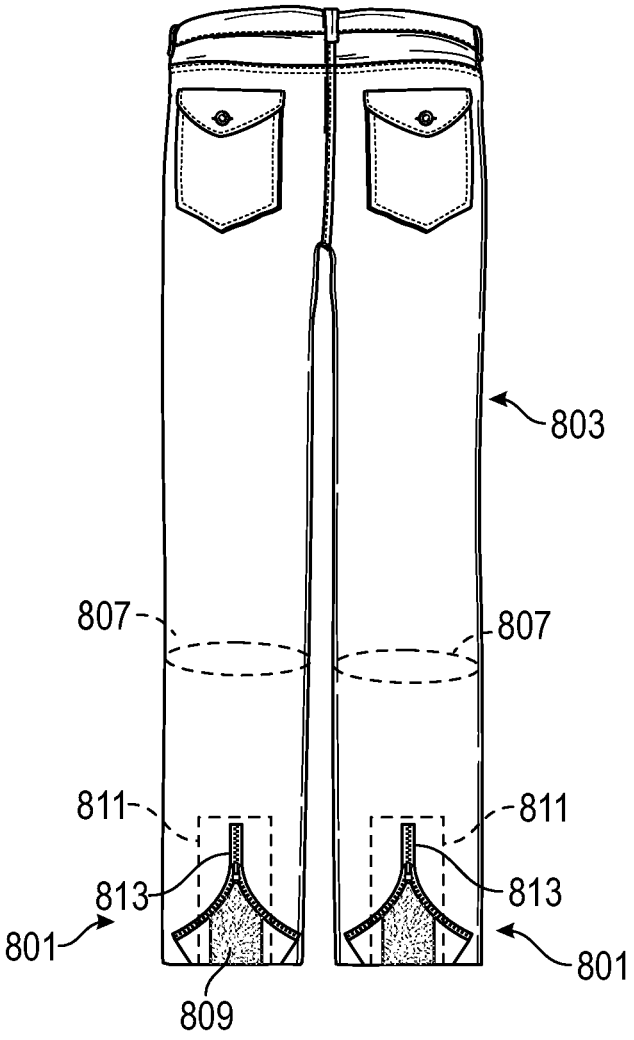
FIG. 9 is a back view of a pair of pants that include a stalk sock.
Figure 10:
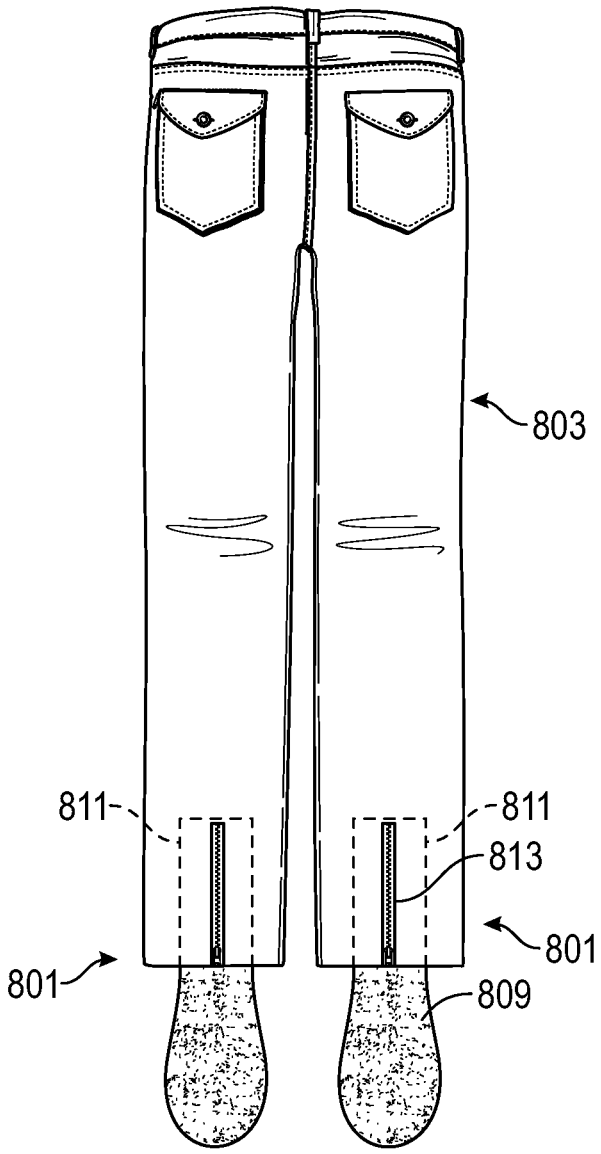
FIG. 10 is another back view of the pair of pants that include a stalk sock.
Figure 11:
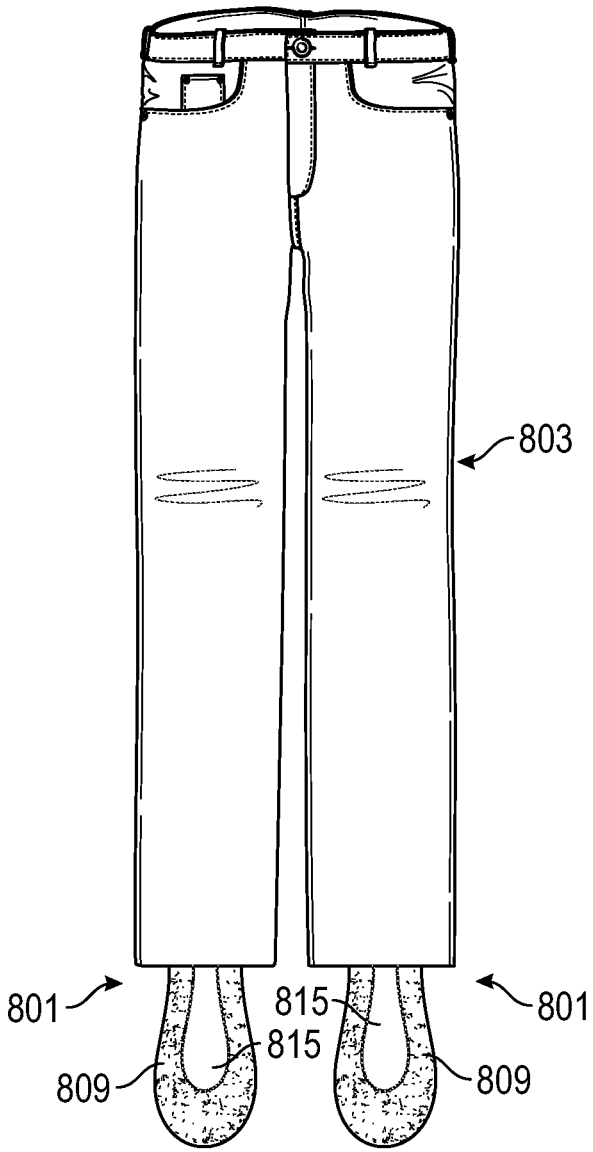
FIG. 11 is a front view of the pair of pants that include a stalk sock.

FIGS. 9-11 illustrate another embodiment in which a stalk sock 801 is provided as part of a pair of pants 803. Each leg of the pants 803 can have a stalk sock 801. Any of the stalk socks disclosed herein can be used in combination with a pair of pants. In particular, the leg covering portion would simply be the pant leg structure itself, and the boot covering portion could function as described herein for each embodiment.

For example, as shown in FIG. 9, a leg covering can comprise the entire pant leg, or it can be a shorter leg covering such as those described elsewhere herein. For convenience, an optional upper edge 807 of the stalk sock 801 is shown in FIG. 9. This is illustrated to show how the stalk sock 801 would appear if it was constructed as in other embodiments described herein, rather than as part of a pair of pants.

FIG. 9 illustrates the boot covering 809 retained in a pocket 811 that is closable by, for example, a zipper element 813. To secure the boot covering 809, it is simply pulled up into the pocket 811 and the zipper element 813 is closed. Preferably, the pocket is long enough to retain the boot covering without bunching (e.g., the same length or greater than the boot covering).

As shown in FIG. 10, the boot covering 809 can be removed so that it extends from an end of the boot leg and the zipper can be closed again. FIG. 11 illustrates a front view of the boot covering after it has been removed from the pocket. As shown in FIG. 11 and described above in detail in other embodiments, an opening 815 in each boot covering allow it to be positioned over the sole of a user's boot (or foot if no boot is being worn).

In view of the many possible embodiments to which the principles of the disclosure may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. A footwear covering system comprising:

a leg covering comprising a first end, a second end, and a retention structure; and a footwear covering coupled to the retention structure and configured to move from a first position in which it is retained by the retention structure and a second position in which the footwear covering extends over a sole of an article of footwear, the footwear covering comprising a sole portion, a heel portion, a toe portion, and an opening that extends from the heel portion to the toe portion, wherein in the second position, the opening of the footwear covering exposes an instep region of the article of footwear.

2. The footwear covering system of claim 1, further comprising a fastening element that at least partially surrounds the opening.

3. The footwear covering system of claim 1, further comprising a fastening element that extends across a portion of the opening.

4. The footwear covering system of claim 2, wherein the fastening element comprises an elastic cord.

5. The footwear covering system of claim 1, wherein the retention structure comprises a pocket into which the footwear covering can be at least partly received when the footwear covering system is in the first position.

6. The footwear covering system of claim 1, wherein the retention structure comprises an aperture sized to receive at least a portion of the footwear covering when in the first position.

7. The footwear covering system of claim 1, wherein the retention structure comprises a strap element.

8. The footwear covering system of claim 1, wherein the retention structure is positioned on an outside surface of the leg covering.

9. The footwear covering system of claim 1, wherein the retention structure is positioned on an inside surface of the leg covering.

10. The footwear covering system of claim 1, wherein the sole portion of the footwear covering comprises a layer of padding.

11. The footwear covering system of claim 1, wherein the sole portion comprises an inner surface and an outer surface, wherein at least the outer surface comprises a fabric.

12. The footwear covering system of claim 11, wherein the fabric of the outer surface is a wool material.

13. The footwear covering system of claim 11, wherein the fabric of the outer surface is a fleece material.

14. The footwear covering system of claim 11, wherein the fabric of the outer surface is a fleece material.

15. The footwear covering system of claim 11, wherein the outer surface comprises a plurality of traction elements.

16. The footwear covering system of claim 1, wherein the footwear covering is removably coupled to the retention structure.

17. The footwear covering system of claim 1, wherein the leg covering comprises a portion of a pant leg.

18. The footwear covering system of claim 1, wherein the first end and second end of the leg covering comprise one or more elastic elements adapted to apply encircling pressure.

19. The footwear covering system of claim 1, wherein the footwear covering comprises a lacing component adapted to tighten or loosen the opening of the footwear covering.

* * * * *